US009230756B2

(12) United States Patent
Pharne

(10) Patent No.: US 9,230,756 B2
(45) Date of Patent: Jan. 5, 2016

(54) CIRCUIT BREAKER HANDLE ACTUATION DEVICE

(71) Applicant: Ajit Pharne, Dekalb, IL (US)

(72) Inventor: Ajit Pharne, Dekalb, IL (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 99 days.

(21) Appl. No.: 13/973,059

(22) Filed: Aug. 22, 2013

(65) Prior Publication Data

US 2015/0053540 A1 Feb. 26, 2015

(51) Int. Cl.

| | |
|---|---|
| ***H01H 3/20*** | (2006.01) |
| ***H01H 15/00*** | (2006.01) |
| ***H01H 21/02*** | (2006.01) |
| ***H01H 71/52*** | (2006.01) |
| *H01H 3/04* | (2006.01) |

(52) U.S. Cl.

CPC ..... *H01H 21/02* (2013.01); *H01H 71/521* (2013.01); *H01H 3/04* (2013.01)

(58) Field of Classification Search

CPC ..... H01H 3/20; H01H 15/00; H01H 3/00; H01H 3/02; H01H 3/001; H01H 3/3031; H01H 3/3042; H01H 3/32; H01H 3/38; H01H 3/54; H01H 9/0044; H01H 69/00; H01H 71/00; H01H 71/02; H01H 71/0214; H01H 71/025; H01H 71/0264; H01H 71/0271; H01H 71/10; H01H 71/1072; H01H 71/128; H01H 71/50; H01H 71/52; H01H 71/521; H01H 71/522; H01H 71/523; H01H 71/05

USPC ..... 200/332

See application file for complete search history.

(56) References Cited

U.S. PATENT DOCUMENTS

| | | | | |
|---|---|---|---|---|
| 3,609,261 | A | 9/1971 | Rys | |
| 4,831,221 | A * | 5/1989 | Yu et al. | 200/553 |
| 6,423,913 | B1 * | 7/2002 | Gupta et al. | 200/50.11 |
| 6,992,256 | B1 | 1/2006 | Chan | |

OTHER PUBLICATIONS

PCT International Search Report mailed Sep. 25, 2014 corresponding to PCT Application No. PCT/US2014/050025 filed Aug. 7, 2014 (9 pages).

* cited by examiner

*Primary Examiner* — Edwin A. Leon
*Assistant Examiner* — Anthony R. Jimenez

(57) ABSTRACT

A circuit breaker handle actuation device used in conjunction with a circuit breaker having a circuit breaker handle and an external handle located on an electrical enclosure. The device includes a stationary frame having first and second horizontal supports. The device also includes a rotatable frame having first and second horizontal elements which extend from first and second vertical elements, respectively. The first and second vertical elements are rotatably attached to the first and second horizontal supports. In addition, an opening for receiving the circuit breaker handle is located between the first and second vertical elements. Further, the device includes a rotatable bracket having first and second vertical arms which are rotatably attached to the first and second horizontal elements, respectively, wherein the rotatable bracket is connected to the external handle. Movement of the external handle between ON, OFF and RESET/PARK positions causes corresponding movement of the circuit breaker handle.

12 Claims, 7 Drawing Sheets

CIRCUIT BREAKER HANDLE ACTUATION DEVICE

FIELD OF THE INVENTION

A circuit breaker handle actuation device used in conjunction with an external handle located on an electrical enclosure, and in particular, a device having a rotatable frame for receiving a circuit breaker handle, a rotatable bracket and an attachment arm connected to the external handle wherein movement of the external handle between ON, OFF and RESET/PARK positions causes corresponding movement of the circuit breaker handle. Also, if the circuit breaker trips and the circuit breaker handle moves to a TRIP position, the device translates the motion to the external handle to show a corresponding TRIP position.

BACKGROUND OF THE INVENTION

Power distribution systems such as motor control centers include a floor mounted electrical enclosure which houses motor control units, wireways, internal wiring, bus bars, circuit breakers and other equipment in accordance with NEMA standards. It is desirable that the footprint of a motor control center, such as those used on an oil rig or for commercial construction, be reduced or minimized in order to reduce costs.

A motor control center enclosure includes one or more large frame circuit breakers such as Siemens VL circuit breakers. Further, the enclosure includes shelf sections having a range of heights, for example, from 60 inches to 6 inches. In one embodiment, a large frame circuit breaker is located on a relatively tall shelf section. The circuit breaker is actuated by separate handle mechanism that is connected to an external handle located on a front panel of the enclosure. It is desirable to locate a large frame circuit breaker in a short shelf section. However, the current handle mechanism does not fit within the short shelf section since the circuit breaker itself occupies a large portion of the shelf. Further, the current handle mechanism must be disassembled in order to gain access to the circuit breaker, thus increasing assembly time and maintenance costs.

SUMMARY OF THE INVENTION

A circuit breaker handle actuation device used in conjunction with a circuit breaker having a circuit breaker handle and an external handle located on an electrical enclosure is disclosed. The device includes a stationary frame having first and second horizontal supports. The device also includes a rotatable frame having first and second horizontal elements which extend from first and second vertical elements, respectively. The first and second vertical elements are rotatably attached to the first and second horizontal supports. In addition, an opening for receiving the circuit breaker handle is located between the first and second vertical elements. Further, the device includes a rotatable bracket having first and second vertical arms which are rotatably attached to the first and second horizontal elements, respectively, wherein the rotatable bracket is connected to the external handle. Movement of the external handle between ON, OFF and RESET/PARK positions causes corresponding movement of the circuit breaker handle. Also, if the circuit breaker trips and the circuit breaker handle moves to a TRIP position, the device translates the motion to the external handle to show a corresponding TRIP position.

DESCRIPTION OF THE INVENTION

Figure 1:
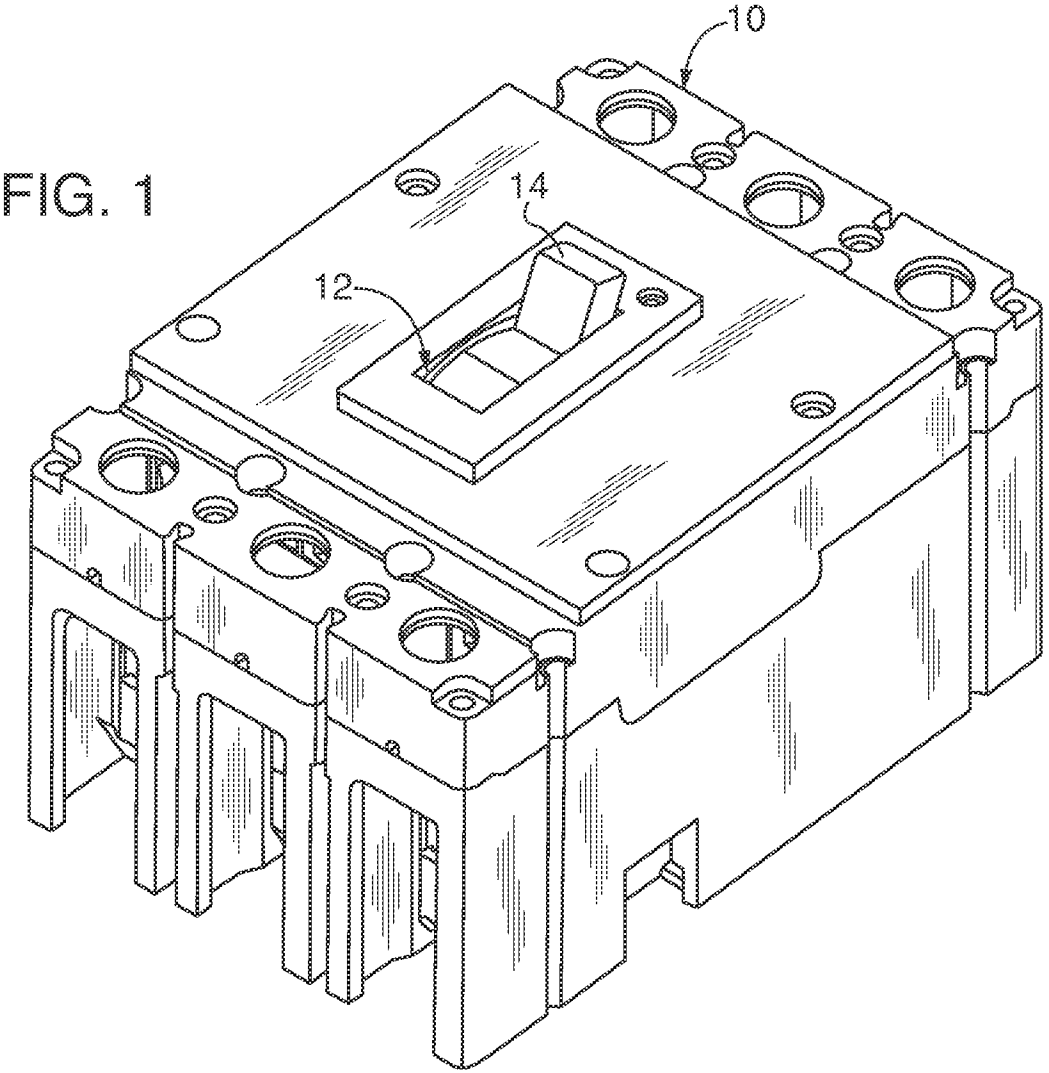
FIG. 1 generally illustrates an exemplary circuit breaker of the type used in a motor control center.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-6.

FIG. 1 generally illustrates an exemplary circuit breaker 10 of the type used in a motor control center. In one embodiment, the circuit breaker 10 may be a commercially available circuit breaker such as a VL series circuit breaker manufactured by Siemens. The circuit breaker 10 includes a circuit breaker handle 12 that moves between known "on", "off", "trip" and "reset" positions (i.e. ON, OFF, TRIP and RESET positions) each indicating a corresponding operating state of the circuit breaker 10. In particular, a force is applied to a protruding member 14 of the handle 12 to move the protruding member 14 between ON, OFF and RESET positions. When the circuit breaker handle 12 is in the ON and OFF positions, the circuit breaker contacts are closed and open, respectively. In addition, the circuit breaker handle 12 moves to the TRIP position when a circuit breaker mechanism within the circuit breaker 10 is tripped. The circuit breaker 10 is reset after a trip event by moving the handle beyond the OFF position and then to the ON position in a known manner. The circuit breaker 10 may be a three pole breaker having three sets of contacts for interrupting current in each of three respective electrical phases. Although the present invention is described in the context of a three phase circuit breaker, it is contemplated that a single phase circuit breaker or other multi-phase circuit breakers may be used.

Figure 2:
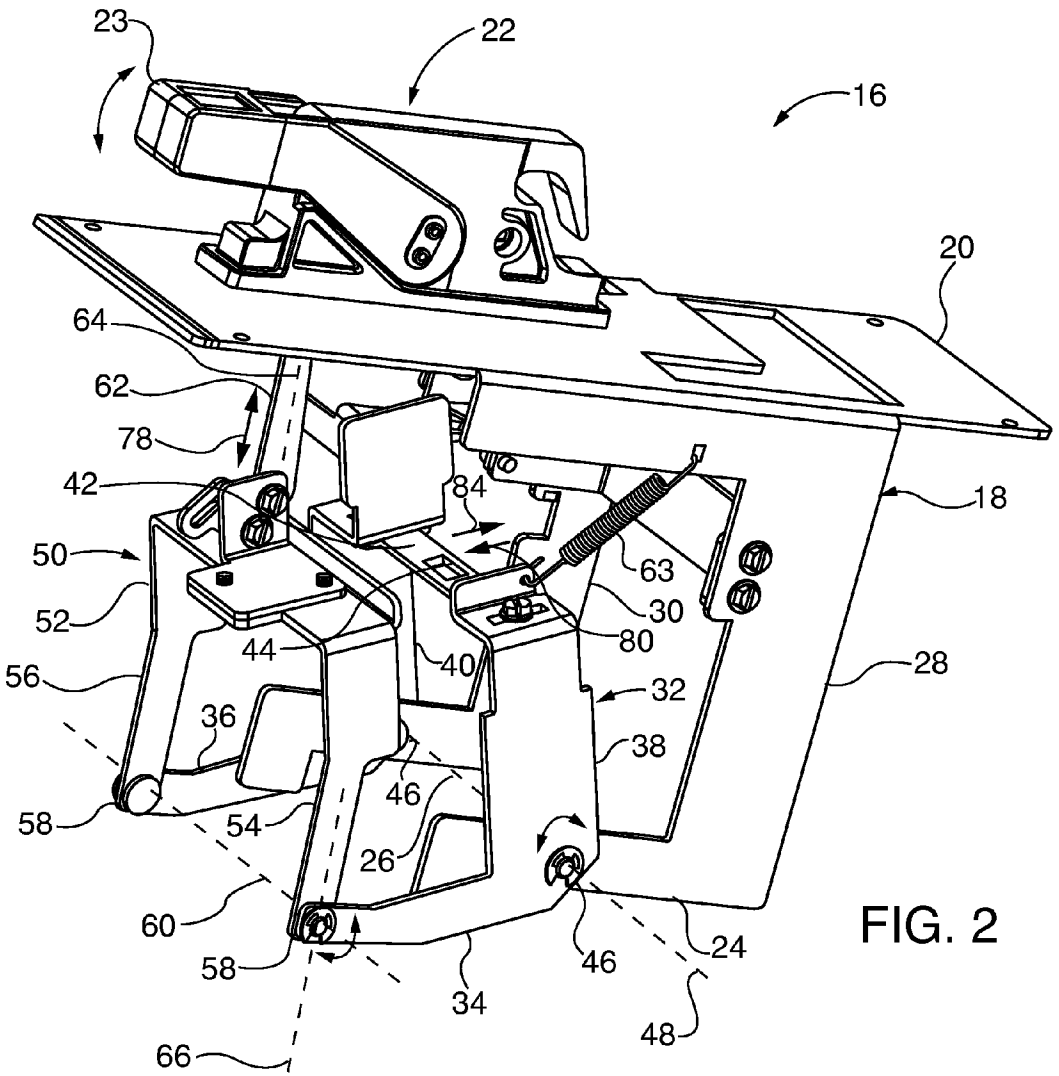
FIG. 2 depicts a handle actuation device in accordance with the present invention.

Referring to FIG. 2, a handle actuation device 16 in accordance with the present invention is shown. The device 16 includes a stationary frame 18 and a faceplate 20 having an external handle assembly 22. The external handle assembly 22 may be a commercially available external handle assembly such as the external handle assembly manufactured by Siemens having part number D73944024. The external handle assembly 22 serves as a disconnect operating handle which is accessible from a front panel of an electrical enclosure, for example. The external handle assembly 22 includes an external handle 23 which is manually moveable by an operator between ON, OFF and RESET/PARK positions that correspond to the ON, OFF and RESET positions, respectively, of the circuit breaker handle 12. In FIG. 2, the external handle 23 is shown the ON position.

The stationary frame 18 includes first 24 and second 26 horizontal supports which extend from first 28 and second 30 vertical supports to form a substantially reverse L-shaped configuration. The device 16 further includes a rotatable frame 32 having first 34 and second 36 horizontal elements which extend from first 38 and second 40 vertical elements, respectively. A cross member 42 is attached between upper ends of the first 38 and second 40 vertical elements. The cross member 42 includes an opening 44 for receiving the protruding member 14 of the handle 12.

The first 38 and second 40 vertical elements are rotatably attached to the first 24 and second 26 horizontal supports by respective first pivot elements 46 thus enabling rotation of the rotatable frame 32 relative to the stationary frame 18 about a first rotational axis 48. It is understood that other portions of the rotatable frame 32 may be rotatably attached to the first 24 and second 26 horizontal supports, such as at the intersection of the first 38 and second 40 vertical elements and the first 34 and second 36 horizontal elements.

The device 16 further includes a rotatable bracket 50 having a bracket member 52 located between first 54 and second 56 vertical arms. The first 54 and second 56 vertical arms are rotatably attached to the first 34 and second 36 horizontal elements, respectively, of the rotatable frame 32 by respective second pivot elements 58 to enable rotation of the rotatable bracket 50 relative to the rotatable frame 32 about a second rotational axis 60. The bracket member 52 is affixed to an attachment arm 62 that extends from the external handle assembly 22. An arm axis 64 of the attachment arm 62 is offset from a bracket axis 66 transverse to the second rotational axis 60.

Figure 3:
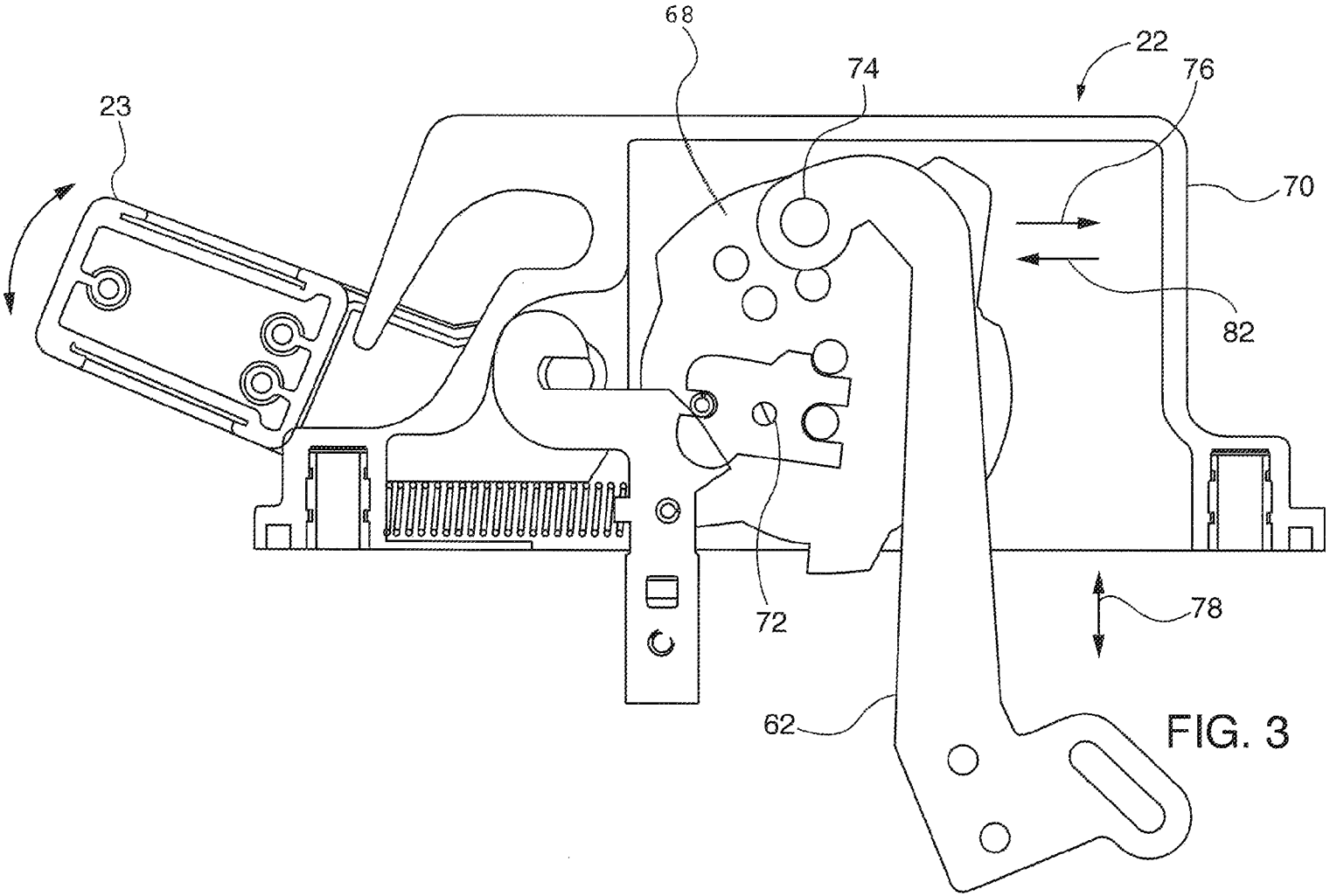
FIG. 3 is a cross sectional view of an external handle assembly in an OFF position.

Referring to FIG. 3, a cross sectional view of the external handle assembly 22 is shown with the external handle 23 in the OFF position. The external handle 23 is attached to a cam 68 that is rotatably mounted to a housing 70 by a third pivot element 72. An end of the attachment arm 62 is rotatably attached to an outer portion of the cam 68 by a fourth pivot element 74. As viewed in FIG. 3, clockwise rotation of the external handle 23 to the ON position (see FIG. 2) causes rotation of the cam 68 about the third pivot element 72 and rotation of the attachment arm 62 about the fourth pivot element 74. The cam 68 and attachment arm 62 are configured such that the attachment arm 62 is first displaced in a horizontal direction (as indicated by arrow 76) and then in a downward direction (arrow 78) along arm axis 64. Referring back to FIG. 2, the displacement of the attachment arm 62 depicted in FIG. 3 causes downward movement of the rotatable bracket 50, counterclockwise rotation of rotatable bracket 50 about the second rotational axis 60 and simultaneous counterclockwise rotation of the rotatable frame 32 about the first rotational axis 48 thus displacing the cross member 42 in a substantially horizontal direction as indicated by arrow 80.

Referring back to FIG. 3, counterclockwise rotation of the external handle 23 to the OFF position causes opposite rotation of the cam 68 about the third pivot element 72 and the attachment arm 62 about the fourth pivot element 74. The cam 68 is configured such that the attachment arm 62 is displaced in a horizontal direction (as indicated by arrow 82) that is opposite direction 76. The attachment arm 62 is then displaced in an upward direction (arrow 78). Referring back to FIG. 2, the displacement of the attachment arm 62 causes upward movement of the rotatable bracket 50, clockwise rotation of rotatable bracket 50 about the second rotational axis 60 and simultaneous clockwise rotation of the rotatable frame 32 about the first rotational axis 48 thus displacing the cross member 42 in a substantially horizontal direction (arrow 84) that is opposite direction 80. In addition to the ON and OFF positions, the external handle may be moved to the RESET/PARK position to enable opening and closing of a door of an electrical enclosure.

Figure 4:
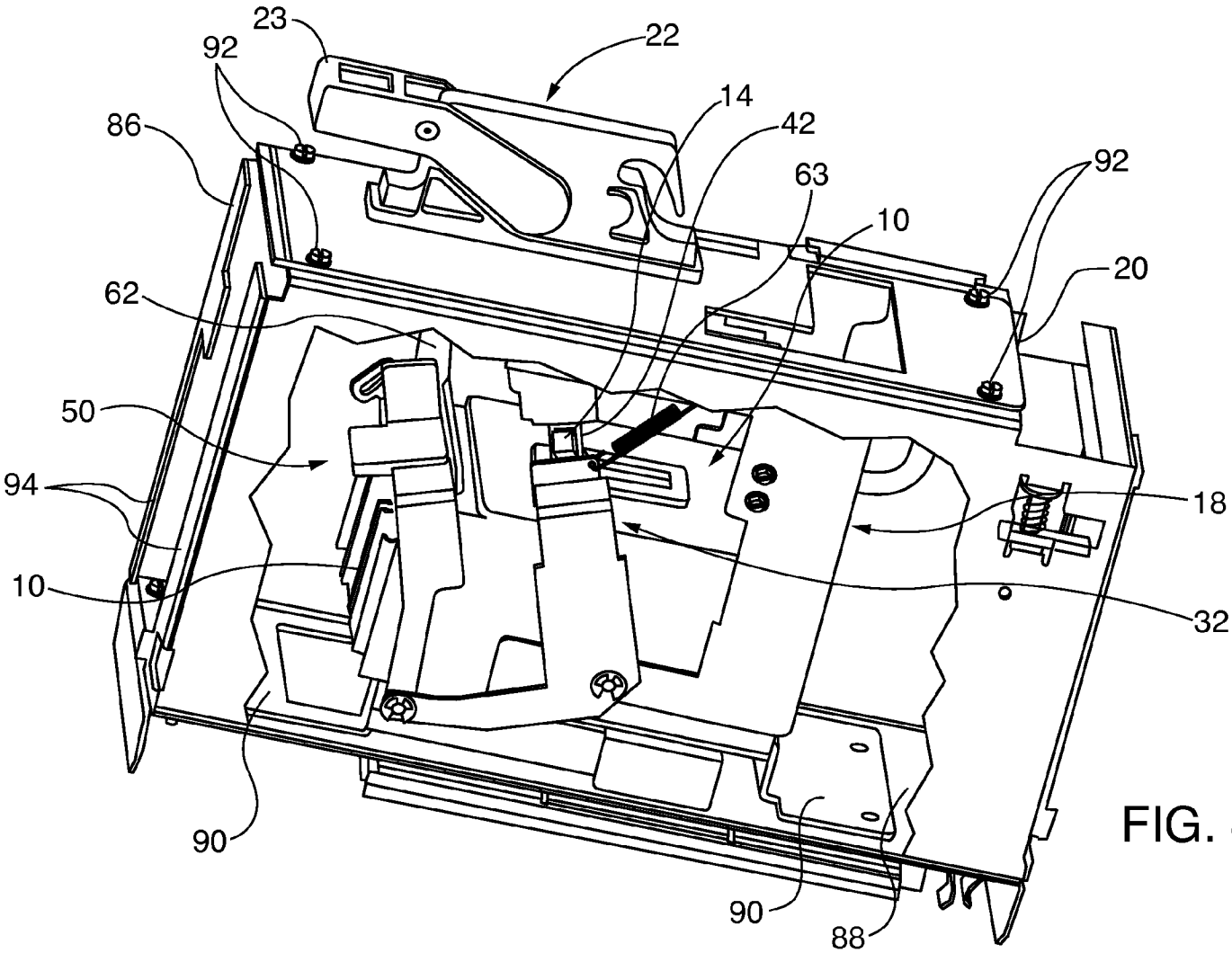
FIG. 4 is a view of the device assembled to a shelf section used in an electrical enclosure.

Referring to FIG. 4, the device 16 is shown assembled to a shelf section 86 used in an electrical enclosure. The shelf section 86 includes a bottom surface 88 located between side walls 94. The bottom surface 88 includes brackets 90 for securing the circuit breaker 10. The device 16 is positioned such that the protruding member 14 is located within the opening 44 in the cross member 44 and the circuit breaker 10 is located between the first 24 and second 26 horizontal supports, first 34 and second 36 horizontal elements and first 54 and second 56 vertical arms. The device 16 is then secured to the shelf section 86 via fasteners 92.

In addition, the device 16 includes a spring 63 that is attached between an upper portion of the stationary frame 18 and the first vertical element 38. When the circuit breaker 10 trips, the protruding portion 14 of the circuit breaker handle 12 moves to the TRIP position. The spring then pulls on the first vertical element 38 to cause clockwise rotation of the rotatable frame 32 and rotatable bracket 50 about the first 48 and second 60 rotational axes, respectively. This displaces the attachment arm 62 in an upward direction (arrow 78) by a sufficient amount to cause the external handle 23 to move to a corresponding TRIP position.

Figure 5A:
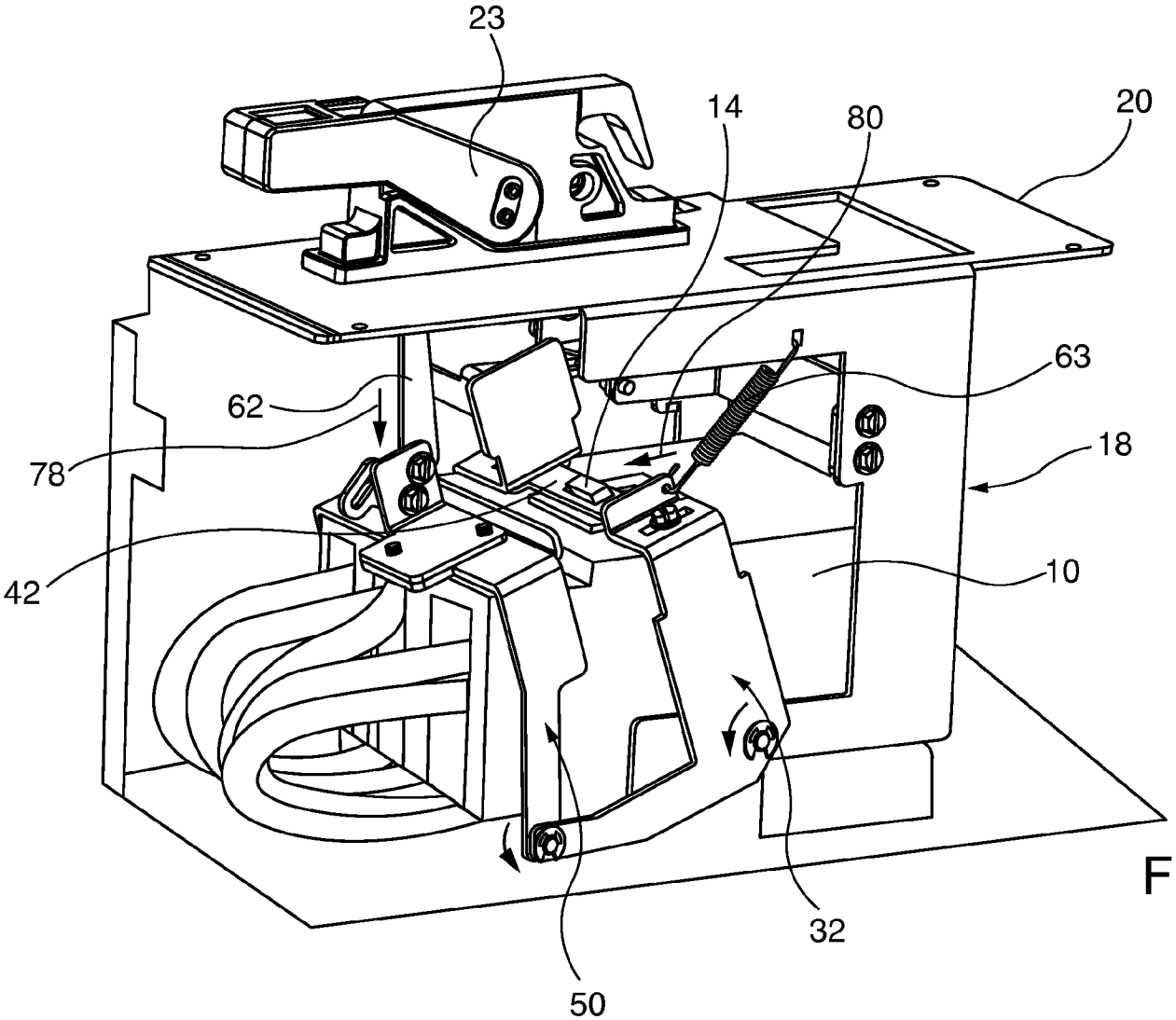
FIGS. 5A and 5B depict the external handle positioned in ON and OFF positions and associated movement of an attachment arm, rotatable bracket and rotatable frame to move a circuit breaker handle to corresponding ON and OFF positions.

Referring to FIG. 5A, the external handle 23 is shown in the ON position and the attachment arm 62 is shown displaced in the downward direction (arrow 78) along arm axis 64. In addition, the rotatable bracket 50 and rotatable frame 32 are shown rotated counterclockwise thus displacing the cross member 42 in a substantially horizontal direction 80 (see FIG. 2) and moving the protruding member 14 of the handle 12 to a corresponding ON position.

Figure 5B:
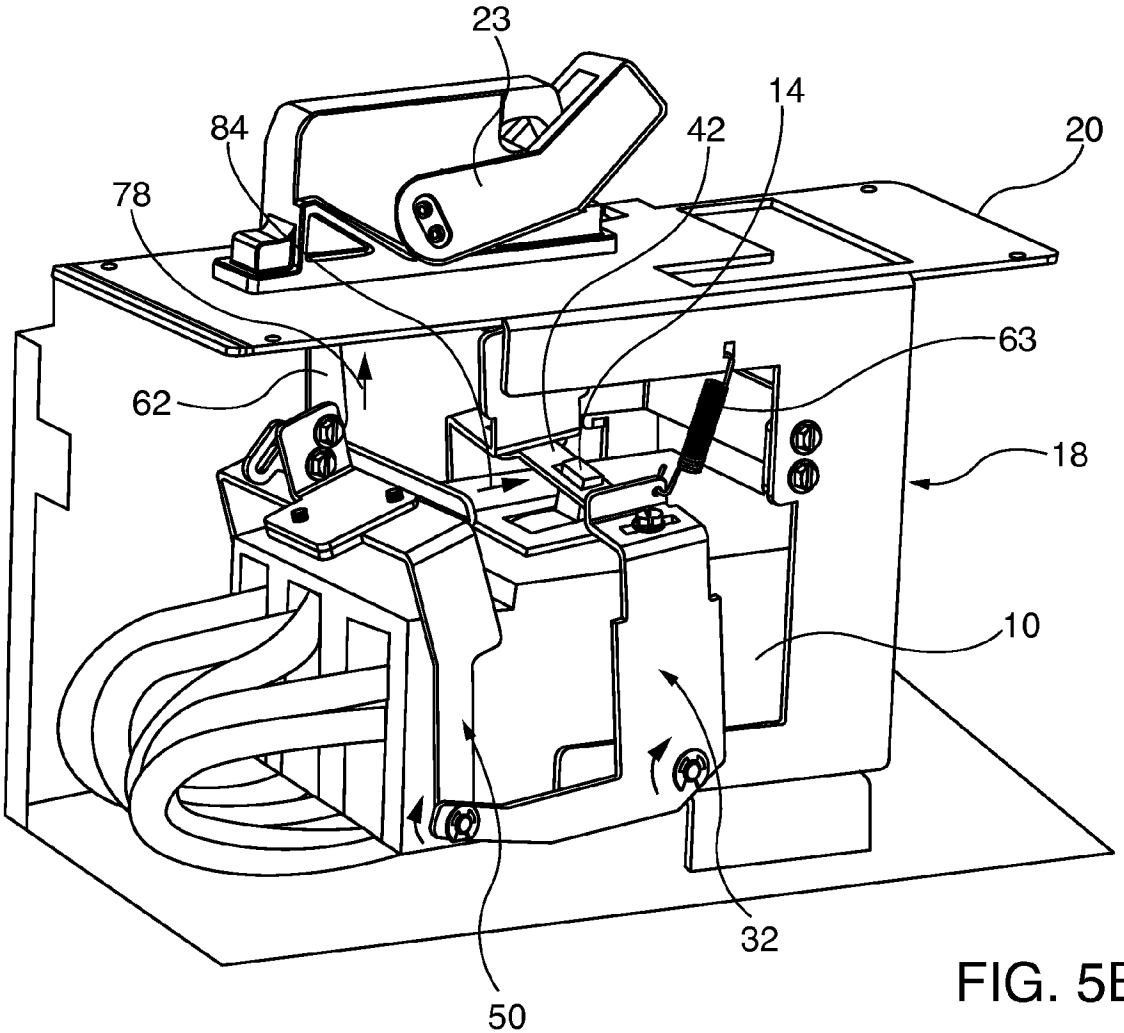

Referring to FIG. 5B, the external handle 23 is shown in the OFF position and the attachment arm 62 is shown displaced in the upward direction (arrow 78) along arm axis 64. In addition, the rotatable bracket 50 and rotatable frame 32 are shown rotated clockwise thus displacing the cross member 42 in substantially horizontal direction 84 (see FIG. 2) and moving the protruding member 14 of the handle 12 to a corresponding OFF position.

Figure 6:
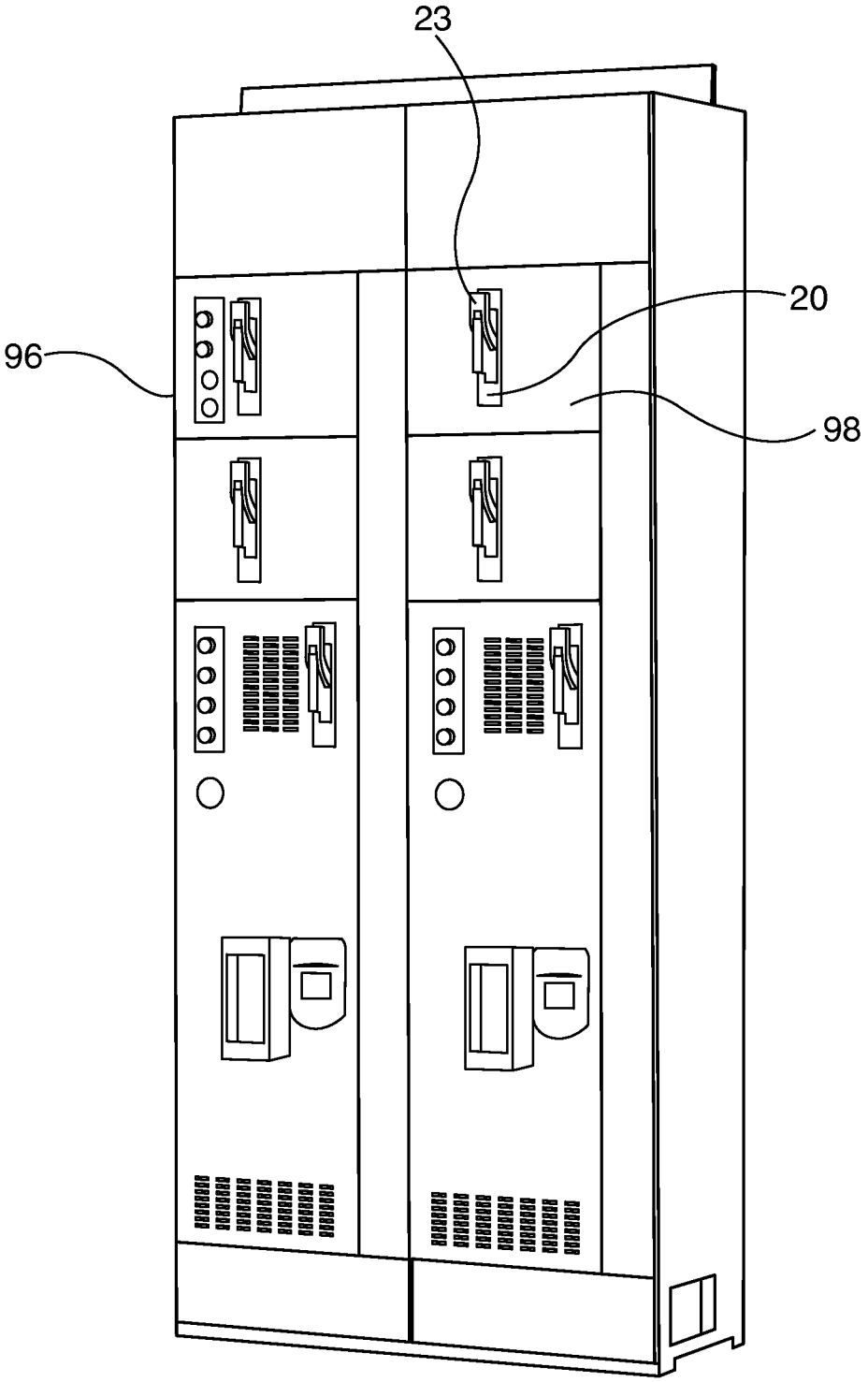
FIG. 6 depicts an electrical enclosure and the external handle and a faceplate.

Referring to FIG. 6, an electrical enclosure 96 for a motor control center is shown. The external handle 23 and faceplate 20 are shown located on a front panel 98 of the electrical enclosure 96. In this view, the shelf section 86, which includes the device 16, is located inside the electrical enclosure 96. As previously described, the external handle 23 is manually moveable by an operator between ON, OFF and RESET/PARK positions. The device 16 enables the use of an existing external handle assembly with a large frame circuit breaker. In addition, the device 16 serves as a subassembly which may be easily removed to allow ready access to an associated circuit breaker for routine maintenance.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

What is claimed is:

1. A circuit breaker handle actuation device used in conjunction with a circuit breaker having a circuit breaker handle, comprising:

a stationary frame having first and second horizontal supports;

a rotatable frame having first and second horizontal elements which extend from first and second vertical elements, respectively, wherein the first and second vertical elements are rotatably attached to the first and second horizontal supports and wherein an opening for receiving the circuit breaker handle is located between the first and second vertical elements;

a rotatable bracket having first and second vertical arms rotatably attached to the first and second horizontal elements, respectively; and an external handle having an attachment arm, wherein the attachment arm is attached to the rotatable bracket and movement of the external handle causes corresponding movement of the circuit breaker handle, and wherein the attachment arm is rotatably attached to a cam located in the external handle.

2. The device according to claim 1 wherein the circuit breaker is located between the first and second horizontal supports, the first and second horizontal elements and the first and second vertical arms.

3. The device according to claim 1 wherein the first and second vertical elements are rotatably attached to the first and second horizontal supports and the first and second vertical arms are rotatably attached to the first and second horizontal elements by pivot elements.

4. The device according to claim 1 further including a spring attached between the stationary frame and the first vertical element wherein when the circuit breaker trips, the spring pulls on the first vertical element to cause rotation of the rotatable frame and rotatable bracket to cause the external handle to move to a TRIP position.

5. The device according to claim 1 wherein the device is located in a shelf section having a faceplate for mounting to an electrical enclosure.

6. A method for actuating a circuit breaker handle, comprising the steps of:

providing a circuit breaker handle actuation device comprising:

providing a stationary frame having first and second horizontal supports;

providing a rotatable frame having first and second horizontal elements which extend from first and second vertical elements, respectively, wherein the first and second vertical elements are rotatably attached to the first and second horizontal supports of the stationary frame, wherein the frame includes an opening for receiving the circuit breaker handle located between the first and second vertical elements;

providing a rotatable bracket having first and second vertical arms rotatably attached to the first and second horizontal elements of the rotatable frame; and providing an external handle having an attachment arm, wherein the attachment arm is attached to the rotatable bracket and movement of the external handle causes corresponding movement of the circuit breaker handle, and wherein the attachment arm is rotatably attached to a cam located in the external handle.

7. The method according to claim 6 further including providing a spring attached between the stationary frame and the rotatable frame wherein when the circuit breaker trips, the spring pulls on the rotatable frame to cause rotation of the rotatable frame and rotatable bracket and causes movement of the external handle to move to a TRIP position.

8. The method according to claim 6 wherein rotation of the rotatable frame and rotatable bracket causes the circuit breaker handle to move between ON, OFF and RESET positions.

9. The method according to claim 6 wherein the circuit breaker handle actuation device is located in a shelf section having a faceplate for mounting to an electrical enclosure.

10. The method according to claim 6 wherein the first and second vertical elements are rotatably attached to the first and second horizontal supports and the first and second vertical arms are rotatably attached to the first and second horizontal elements by pivot elements.

11. The method according to claim 6 wherein the circuit breaker is located between the first and second horizontal supports, the first and second horizontal elements and the first and second vertical arms.

12. The device according to claim 1 wherein movement of the external handle causes rotation of the rotatable frame and rotatable bracket to cause the circuit breaker handle to move between ON, OFF and RESET positions.

* * * * *